US005274214A

United States Patent [19]

Blackburn

[11] Patent Number: 5,274,214

[45] Date of Patent: Dec. 28, 1993

[54] BATTERY POWERED PORTABLE CIGARETTE LIGHTER HAVING A PRESS-FITTED CERAMIC HEAT CONCENTRATING AND PROTECTIVE RESISTANCE HEATING FILAMENT SUPPORT

[75] Inventor: William G. Blackburn, Clearwater, Fla.

[73] Assignee: Electra-Lite, Inc., Clearwater, Fla.

[21] Appl. No.: 997,973

[22] Filed: Dec. 28, 1992

Related U.S. Application Data

[63] Continuation-in-part of Ser. No. 817,564, Jan. 7, 1992.

[51] Int. Cl.[5] ..... F23Q 7/16; H05B 3/26

[52] U.S. Cl. ..... 219/268; 219/267; 219/270

[58] Field of Search ..... 219/260-270

[56] References Cited

U.S. PATENT DOCUMENTS

| | | | |
|---|---|---|---|
| 1,505,248 | 8/1924 | Extrom | 219/270 |
| 1,620,327 | 3/1927 | Dennis | 219/266 |
| 1,697,615 | 1/1929 | Sinko | 219/262 X |
| 1,727,002 | 9/1929 | Weaver | 219/267 |
| 1,763,343 | 6/1930 | Cohen | 219/267 |
| 2,199,885 | 5/1940 | Kravchuk | 219/268 X |
| 2,240,678 | 5/1941 | Stanard | 219/268 X |
| 2,535,665 | 12/1950 | Boyarsky | 219/268 |
| 3,098,923 | 7/1963 | Behrendt | 219/268 X |
| 3,392,265 | 7/1968 | King et al. | 219/268 X |
| 3,419,704 | 12/1968 | Hunt . | |

FOREIGN PATENT DOCUMENTS

| | | | |
|---|---|---|---|
| 1203030 | 7/1959 | France | 219/268 |
| 256630 | 2/1949 | Switzerland | 219/268 |
| 350823 | 1/1961 | Switzerland | 219/268 |
| 314773 | 6/1929 | United Kingdom | 219/268 |
| 2232754 | 12/1990 | United Kingdom | 219/268 |

*Primary Examiner*—Anthony Bartis

*Attorney, Agent, or Firm*—Joseph C. Mason, Jr.; Ronald E. Smith

[57] ABSTRACT

A flameless battery powered electric cigarette lighter has a resistance heating filament positioned within a lighter housing in spaced juxtaposition to an opening in the housing for admitting the leading end of a cigarette so that it may contact the heating filament and be ignited. A cylindrical ceramic support positioned in the housing by an annular rib thereon press fitted into engagement with portions of the housing has a circular recess facing the housing opening in which is positioned the heating filament. The recess protects the filament against breakage and serves to concentrate heat on the cigarette being ignited. The heating filament is automatically energized by a switch actuated by movement of a slidable flexible housing wall portion from a position closing the housing opening to an open position where a cigarette can be inserted through the opening for ignition.

2 Claims, 1 Drawing Sheet

BATTERY POWERED PORTABLE CIGARETTE LIGHTER HAVING A PRESS-FITTED CERAMIC HEAT CONCENTRATING AND PROTECTIVE RESISTANCE HEATING FILAMENT SUPPORT

CROSS-REFERENCE TO RELATED DISCLOSURES

This disclosure is a continuation-in-part of a copending disclosure having the same title by the same inventor, Ser. No. 07/817,564, filed Jan. 7, 1992.

BACKGROUND OF THE INVENTION

1. Technical Field

This invention relates, generally, to portable cigarette lighters. More particularly, it relates to a flameless battery-operated lighter having a recessed lighting means.

2. Description of the Prior Art

Cigarette lighters commonly include a capillary action-dependent wick having a lower end immersed in a fuel and a rotatably mounted flint, disposed in closely spaced relation to the wick, that produces a spark when rotated against a fixed position abrasive member. These lighters have a number of well-known disadvantages relating to the need to maintain fuel therein, the inefficiency of the flint-based spark-producing means, and the like. Moreover, the lighters can be used to start fires, whether intentionally or not.

Additional drawbacks of such conventional lighters are equally well known. For example, the lighter fluid has an unpleasant smell. Moreover, the lighters are heavy and not inexpensive.

Many inventors have developed improvements to the common lighter. Chuange, in U.S. Pat. No. 4,507,704, discloses a battery-operated cigarette lighter that provides current that heats a filament that is positioned within a housing. That device is believed to be the most pertinent of the earlier patents; however, its size, weight, and expense are not inconsiderable.

Additional U.S. patents of interest include U.S. Pat. Nos. 2,030,011, 2,528,619, 2,991,875, and 4,621,649.

Foreign disclosures of interest include Swiss Patent 245,621 and United Kingdom application 2,232,754.

Although the art of cigarette lighters is well-developed, there remains a need for a lighter that cannot be used to start intentional or unintentional fires. There is also a need for a very inexpensive and light in weight lighter. Moreover, in the field of battery-operated cigarette lighters, there is a need for a means that will support the filament that produces the heat needed to ignite a cigarette so that said filament does not break when contacted by the tip of a cigarette.

SUMMARY OF THE INVENTION

The battery-operated cigarette lighter of this invention includes a generally cylindrical ceramic element that supports the filament against breakage, thereby extending its useable lifetime. More particularly, the ceramic element has a recess formed therein into which is received the filament. Advantageously, the recess serves to concentrate the heat generated by the filament so that the tip of the cigarette will ignite even before it physically contacts the filament. This extends the lifetime of the filament even more.

The primary object of this invention is to provide a small, light, inexpensive, battery-operated cigarette lighter.

Another important object is to provide a cigarette lighter that produces no flame and which is therefore safe to operate. A more specific object is to provide a means for extending the lifetime of a filament in a battery-operated cigarette lighter.

These and other important objects, features and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

Figure 1:
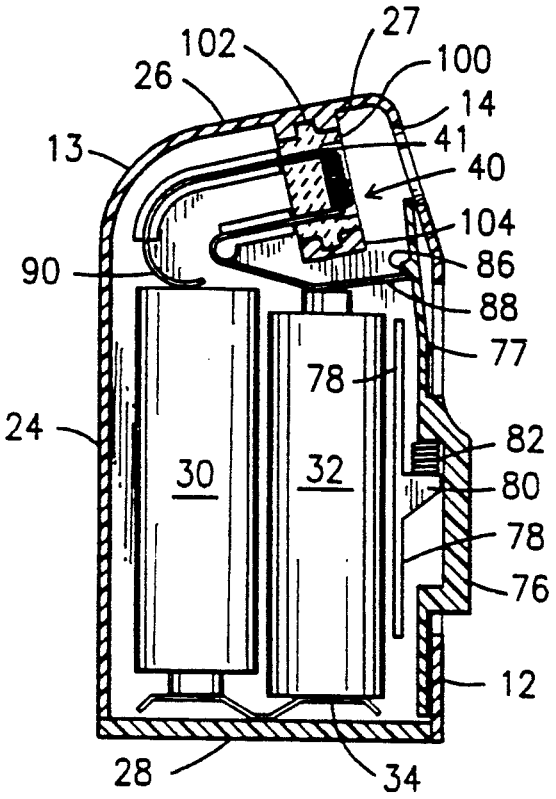
FIG. 1 is a sectional view of the novel cigarette lighter, taken along line 1—1 in FIG. 2.
Figure 2:
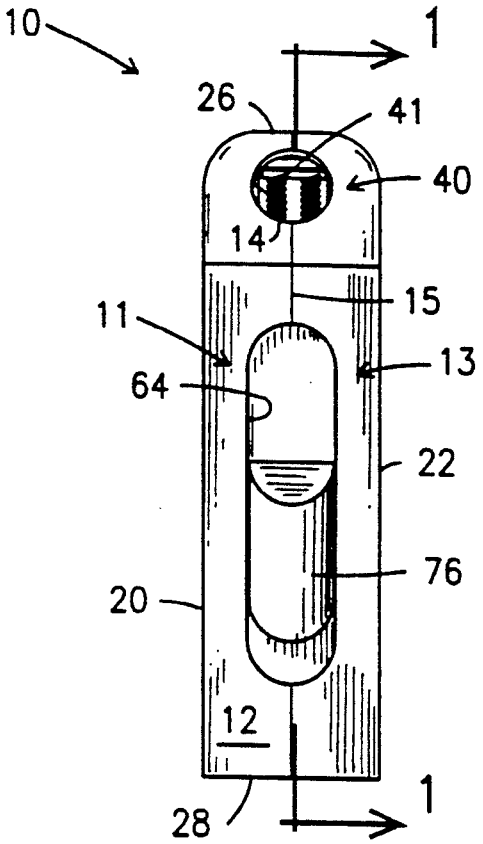
FIG. 2 is a front elevational view of the novel lighter.

Referring first to FIGS. 1 and 2, it will there be seen that the novel lighter is provided in the form of a parallelepiped-in-configuration hollow housing 10 made of two mating casing halves 11 and 13 that meet along parting line 15.

Housing 10 includes front wall 12, rear wall 24, top wall 26, bottom wall 28, and side walls 20, 22. Circular opening 14 is formed in front wall 12; the predetermined diameter of opening 14 is insufficient to receive the tip of a human finger therein, but is sufficient to receive the tip of a cigarette.

Batteries 30, 32 are positioned within the hollow interior of housing 10 in side-by-side relation to one another. Conductor 34, formed of a flat, flexible and resilient metal strip, provides electrical communication between batteries 30, 32 and biases them toward conductors 90 and 88, respectively.

Conductor 88 is also made of a flat, flexible and resilient metal strip. Note in FIG. 1 that conductor 88 is in electrical communication with the positive pole of battery 32; such contact between conductor 88 and said positive pole effects the flow of electrical current through filament 40 because conductor 90 electrically interconnects battery 30 (and hence battery 32) to the opposite end of said filament. Note further that conductor 88 is held into this circuit-completing position only when switch actuator 76 compresses bias means 82; such compression is depicted in FIG. 1. More particularly, nub 86 is formed integrally with flexible wall member 77 that extends upwardly from switch actuator 76; wall member 77 is wider than or at least equal to the diameter of opening 14 so that wall 77 does not enter into or extend into said opening when said wall is displaced upwardly from its FIG. 1 position. Such upward travel of wall member 77 occurs when switch actuator 76 is released by the operator of said switch actuator; such release allows bias means 82 to unload and to thereby drive switch actuator 76 and hence wall member 77 upwardly so that said wall member 77 closes opening 14. Such upward travel further causes nub 86 to allow the free end of flexible and resilient conductor 88 to travel upwardly, i.e., away from the positive pole of battery 32, under its own bias, thereby stopping current flow through filament 40.

The lower end of bias means 82 is supported by ledge 80 which is formed integrally with wall 78; wall 78 has elongate opposite sides that are fixedly secured by suitable means to the respective interior surfaces of side walls 20, 22. Thus, ledge 80 has a fixed position as well so that bias means 82 is compressed when switch actuator 76 is displaced downwardly as depicted in FIG. 1 as aforesaid, and so that bias means 82 is uncompressed when switch actuator 76 is released by the individual using the lighter.

Figure 3:
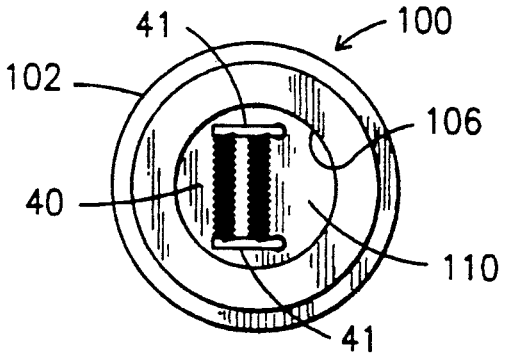
FIG. 3 is a front elevational view of the novel filament supporter.
Figure 4:
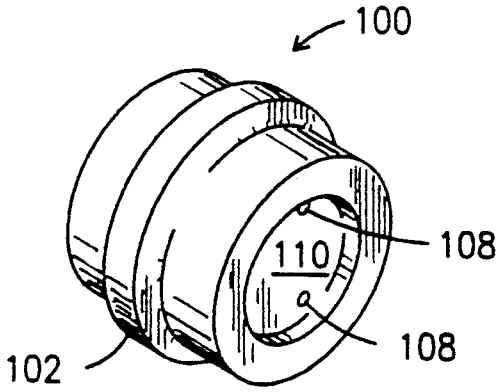
FIG. 4 is a perspective view of said filament supporter.

The novel filament holder is denoted 100 as a whole in FIGS. 1, 3 and 4. It is a ceramic element and has a generally cylindrical configuration as shown and includes a raised central rib 102, formed about mid-length thereof, that facilitates its attachment to housing 10. As shown in FIG. 1, ceramic element 100 is positioned within casing 13 near top wall 26 thereof so that rib 102 engages mounting surface 27 formed integrally with said top wall. A similar mounting wall 104 is spaced from said inner surface by a distance substantially equal to the outer diameter of the annular rib 102, so that ceramic element 100 may be installed within the casing by press fitting it into the position depicted in FIG. 1.

A recess 106 is formed in the leading end of cylindrical ceramic element 100 as shown. As will become more clear as this description proceeds, this recess causes the heat generated by filament 40 to be concentrated within the area of the recess.

A pair of parallel bores, collectively denoted 108, are formed in ceramic element 100 to receive therethrough electrical conductors 88, 90. Filament 40 has its opposite ends secured to said conductors. Note, however, that filament 40 closely overlies bottom wall 110 of recess 106. Thus, if the leading end of a cigarette is firmly pressed against the filament, the filament is supported by said bottom wall and therefore cannot break. Moreover, in view of the concentration of the heat generated by the filament, the leading end of a cigarette will ignite even before it touches the filament.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A battery-operated cigarette lighter, comprising:

a hollow housing;

said hollow housing formed by a pair of mating casing halves;

said hollow housing having a top wall, a bottom wall, a front wall, a rear wall, and a pair of side walls;

a battery means disposed within said hollow housing;

a filament disposed within said hollow housing;

a filament-supporting member disposed within said hollow housing;

an opening formed in said hollow housing for receiving a cigarette thereinto so that a cigarette may abut said filament;

said filament-supporting member having a generally cylindrical configuration and having an annular raised rib formed therein about mid-length thereof;

said filament-supporting member having a leading end and a trailing end;

a generally circular recess formed in said leading end;

said generally circular recess having a bottom wall;

said filament being disposed in said recess in closely spaced relation to said bottom wall;

a rib-engaging mounting surface formed in an interior surface of said top wall of said hollow housing;

a rib-engaging mounting wall, spaced apart from said rib-engaging mounting surface, positioned within said hollow housing;

said filament-supporting member being press fit into an operative position between said rib-engaging mounting surface and said rib-engaging mounting wall to facilitate assembly of the lighter;

a pair of bores formed in said filament-supporting member;

a pair of conductors, each of which is disposed in electrically communicating relation between said battery means and said filament;

each conductor of said pair of conductors being disposed in an associated bore of said pair of bores;

said filament-supporting member being made of a heat-radiating material so that heat generated by said filament heats said filament-supporting member and so that said generally circular recess concentrates heat within said recess so that a cigarette disposed within or near said recess is ignited easily; and a switch means for selectively activating said filament.

2. The lighter of claim 1, wherein said filament-supporting member is made of ceramic.

* * * * *